US007796033B2

(12) United States Patent
Green et al.

(10) Patent No.: US 7,796,033 B2
(45) Date of Patent: Sep. 14, 2010

(54) SYSTEM AND METHOD FOR CALIBRATING A MICROWAVE MOTION DETECTOR

(75) Inventors: Leslie K. Green, Applegate, CA (US); Xiaodong Wu, Roseville, CA (US); James N. Helland, Folsom, CA (US)

(73) Assignee: Honeywell International Inc., Morristown, NJ (US)

( * ) Notice: Subject to any disclaimer, the term of this patent is extended or adjusted under 35 U.S.C. 154(b) by 427 days.

(21) Appl. No.: 11/940,156

(22) Filed: Nov. 14, 2007

(65) Prior Publication Data

US 2009/0121870 A1 May 14, 2009

(51) Int. Cl.
*G08B 13/18* (2006.01)

(52) U.S. Cl. ..... 340/554; 340/515; 340/500; 340/540; 340/541

(58) Field of Classification Search ..... 340/514, 340/515, 541, 545.2, 506, 500, 554, 565
See application file for complete search history.

(56) References Cited

U.S. PATENT DOCUMENTS 3,838,408 A * 9/1974 McMaster ..... 340/501
3,858,192 A * 12/1974 Fischer ..... 340/528
4,189,719 A * 2/1980 Massa et al. ..... 340/501
4,193,055 A * 3/1980 Barnum ..... 342/28
5,331,308 A * 7/1994 Buccola et al. ..... 340/522
5,386,210 A * 1/1995 Lee ..... 340/567
5,499,012 A * 3/1996 Tracy et al. ..... 340/514
5,524,099 A * 6/1996 Rickman et al. ..... 340/541
5,578,988 A * 11/1996 Hoseit et al. ..... 340/522
5,898,368 A * 4/1999 Handley et al. ..... 340/514
6,239,736 B1 * 5/2001 McDonald et al. ..... 340/554
6,415,205 B1 * 7/2002 Myron et al. ..... 340/522
6,791,458 B2 * 9/2004 Baldwin ..... 340/522
7,616,148 B2 * 11/2009 Wu et al. ..... 342/28
7,636,039 B2 * 12/2009 Babich ..... 340/514
2004/0027270 A1 * 2/2004 Fullerton et al. ..... 340/541
2009/0114800 A1 * 5/2009 Jensen et al. ..... 250/221

* cited by examiner

*Primary Examiner*—Eric M Blount
(74) *Attorney, Agent, or Firm*—Husch Blackwell Sanders Welsh & Katz

(57) ABSTRACT

A method of automatically calibrating a motion detector and a motion detector adapted for calibration using the method. The method comprises setting the motion detector to a calibration mode, waiting a preset period of time for the installer to walk to the furthest distance, receiving a Doppler signal generated by motion at the furthest distance from the microwave motion detector within the protected area, measuring an amplitude of the Doppler signal and storing a motion detection threshold for the microwave motion detector. The motion detection threshold is a proportional to the measured amplitude.

16 Claims, 2 Drawing Sheets

SYSTEM AND METHOD FOR CALIBRATING A MICROWAVE MOTION DETECTOR

FIELD OF THE INVENTION

This invention relates to security systems and sensors. More particularly, the invention relates to a method for calibrating a motion detector and the invention relates to a motion detector.

BACKGROUND

Motion detectors are commonly used to detect and indicate attempts to break into a protected area. There are many different types of motion sensors, such as a PIR sensor, a microwave sensor and a dual technology sensor, which is a combination of the former two. The detectors are typically mounted on a ceiling or wall within the protected area. A microwave motion sensor transmits a microwave signal toward a region to be monitored and in the event that movement is detected within the region, the microwave signal is reflected back from such movement and is modulated due to the Doppler Effect. When a signal is reflected from a moving object (target) it is shifted in frequency. The shift in frequency is called the Doppler Effect and the new frequency is directly proportional to the target velocity. A Doppler sensor uses this principle to detect human motion.

When a detector is installed, the detector is tested to ensure that it is functioning properly. Additionally, the detector is calibrated for the protected area.

Currently, for the dual technology motion detector, the microwave motion detector is calibrated by repeatedly adjusting a potentiometer. Specifically, the installer will walk the farthest distance from the detector within the premises to generate a signal, return to the detector, adjust the potentiometer, and walk the furthest distance again. The potentiometer is adjusted to pick up motion at the maximum distance from the detector within the protected area and closer, but not further.

Each installation is different and requires multiple adjustments. This adjustment process is time consuming and cumbersome. Since the process is cumbersome, some installers will often fail to complete the adjustment of the potentiometer for the protected area.

Accordingly, there is a need to be able to calibrate the detector without requiring substantial effort by an installer.

SUMMARY OF THE INVENTION

Disclosed is a method for automatically calibrating a motion detector. The method comprises the steps of setting the motion detector into a calibration mode, walking to the farthest distance from the motion detector within the protected area, and receiving a Doppler signal generated by motion at the furthest distance from the microwave motion detector within the protected area, measuring an amplitude of the Doppler signal, and storing a motion detection threshold for the microwave motion detector where the motion detection threshold is proportional to the measured amplitude. The method further comprises the step of converting the Doppler signal into a digital signal for measurement. The method further comprises the step of setting the motion detection threshold and confirming that the motion detection threshold is an adequate setting of the microwave motion detector.

The microwave motion detector, when put into the calibration mode, first indicates to the installer to walk to the furthest distance and gives the installer a preset period of time to do this. The sensor then indicates that the installer is to start walking. This indication is indicative of when the preset period of time has expired. Further the indication notifies the installer that the microwave motion detector is ready to receive the Doppler signal.

The method further comprises the steps of timing a second preset period of time in which the installer walks the furthest distance to generate the Doppler signal and resetting the microwave motion detector to alarm mode after the second preset period of time expires. After a preset period of time has elapsed for the walk, the microwave motion detection then indicates that the calibration mode is finished.

The microwave motion detector will record the reflected signal and use it to set the motion detection threshold for the protected area. The measured amplitude is multiplied by a preset parameter to generate the motion detection threshold.

The preset period of time is preset based a microwave motion detector's detection range. A fifty-foot microwave motion detector will have to allow more time for the installer to walk to the furthest distance compared to a 35-foot unit.

The motion detector threshold is a setting for comparison of subsequent signals as received by the microwave circuitry for determination of an intruder.

Also disclosed is a microwave motion detector adapted for calibration according to an embodiment of the invention. The microwave motion detector comprises a calibration activation switch for activating the calibration mode, a timing section for a first preset period of time and a second preset period of time, a microwave circuitry for receiving the Doppler signals during a second preset period of time in which an installer walks a furthest distance from the microwave motion detector, a measurement section for measuring an amplitude of the Doppler signals, a storage section for storing a detection threshold as determined from the measured amplitudes and a notification section for indicating a start of the calibration, and an expiration of the first and second preset periods of time, and if there is trouble with a level of the detection threshold. The first preset period of time is dependent on the size of the protected area.

The microwave motion detector uses the detection threshold for determining whether a received signal is indicative of motion.

Additionally, the microwave motion detector comprises an alarm generation section for generating an alarm based on a comparison between the output of the microwave circuitry and the stored detection threshold.

The calibration activation switch may be responsive to a remote control device. The remote control device can be a security system keypad or a keyfob. The microwave motion detector may also comprise a transceiver for receiving a signal from the security system keyfob or a wired or wireless keypad. The motion detector can be a single technology or dual technology motion detector.

BRIEF DESCRIPTION OF THE DRAWINGS

These and other features, benefits and advantages of the present invention will become apparent by reference to the following text figures, with like reference numbers referring to like structures across the views, wherein.

DETAILED DESCRIPTION OF THE INVENTION

Figure 1:
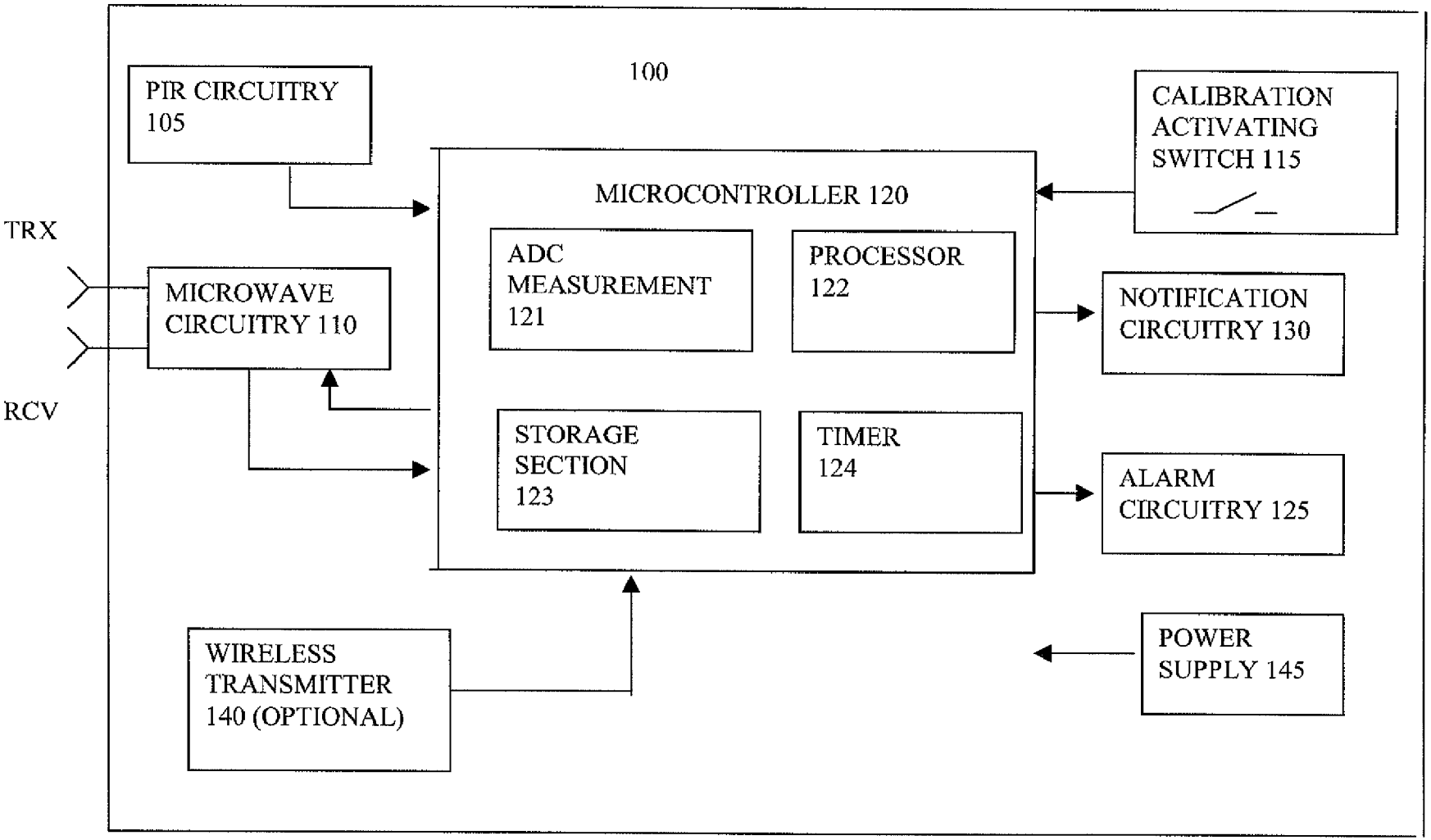
FIG. 1 illustrates a dual technology motion detector according to an embodiment of the invention.

FIG. 1 illustrates a dual technology motion detector 100 according to one embodiment of the invention. The motion detector 100 comprises a PIR circuitry 105 and a microwave circuitry 110. The PIR circuitry 105 and microwave circuitry 110 are used in combination to determine motion within a protected area. An alarm is generated if both the PIR circuitry 105 and the microwave circuitry 110 detect a signal indicative of motion. In another embodiment, a motion detector can be a signal technology motion detector comprising only the microwave circuitry 110 without the PIR circuitry 105.

The motion detector 100 also includes a calibration activating switch 115. This calibration activating switch 115 causes the motion detector 100 to switch to the calibration mode. In an embodiment, the installer physically actuates the calibration activating switch 115. In another embodiment, a remote control device is used. The remote control device can be a security system control panel, a keypad, a keyfob or a handheld controller.

The calibration mode is typically used during installation. The motion detector 100 can only be calibrated in the calibration mode. The motion detector 100 mainly operates in alarm mode. When the motion detector 100 is in alarm mode, the motion detector 100 can generate an alarm. The motion detector 100 also includes a microcontroller 120. The microcontroller 120 can be a microprocessor. The microcontroller 120 processes signals generated by the PIR circuitry 105 and microwave circuitry 110. Specifically, the microcontroller 120 determines if the signals detected by the sensing elements are indicative of motion. The determination is based upon known characteristics of a PIR circuitry response and a comparison of the output from the microwave circuitry 110 with a stored detection threshold. The detection threshold value is stored during the calibration process.

According to the invention, the microcontroller 120 also includes an ADC measuring section 121, a processor 122, storage section 123 and a timer 124. Additionally, the microcontroller 120 includes an A/D converter (ADC). The microcontroller 120 is programmed to control the functionality of the motion detector 100. The timer 124 counts down the wait time, which is a predetermined period of time that the motion detector 100 allows for an installer to walk to the furthest point in the protected area, and a second period of time for the installer to walk the furthest distance, i.e. to generate the Doppler signal The A/D converter converts the received signals into a digital representation for processing. The A/D converter uses a preset sampling rate and will generate "N" samples. The calibration threshold is stored in the storage section 123. The amplitude of the signal received during the calibration mode is used to determine the threshold level. The threshold is stored in the storage section. The measured amplitude of the Doppler signal is multiplied by a preset value to create the detection threshold. The preset value accounts for a tolerance in the detection threshold for factors that effect the amplitude of a Doppler signal.

The motion detector 100 also includes an alarm circuitry 125. The alarm circuitry 125 generates a local alarm indicating that motion has been detected. This alarm generation can be a LED, a relay or may be some signal sent to external devices.

The microcontroller 120 controls the alarm circuitry 125.

The motion detector 120 includes notification circuitry 130. The notification circuitry 130 can include a visual indicator such as a light. Alternatively, the notification circuitry can include an audible indicator such as a siren or a synthesized voice message. The notification circuitry 130 is used for notifying the installer or user the start of the calibration mode, the start of the walk period and the ending of the calibration mode.

The motion detector 100 can optionally include a transmitter 140 for transmitting a signal to a security system indicative of an alarm event. As depicted in FIG. 1 the transmitter 140 is a wireless transmitter. In another embodiment, the transmitter can be a wired communication section.

The motion detector 100 also includes a power supply 145 such as a battery and/or a voltage regulator for power supplied from an external source. The power source 145 provides the power needed for functionality to each element of the motion detector 100.

Figure 2:
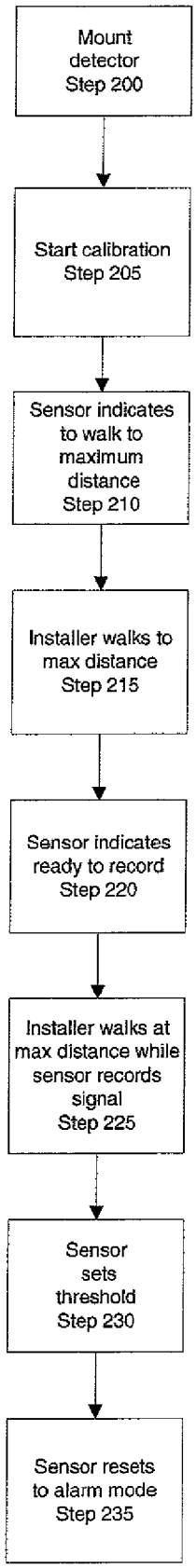
FIG. 2 illustrates a flow chart of a calibration method according to an embodiment of the invention.

FIG. 2 illustrates a calibration method according to an embodiment of the invention. During installation an installer will mount the motion detector 100, at step 200. At step 205, the installer switches the motion detector 100 into a calibration mode, using the calibration activation switch 115. In an embodiment, the installer depresses a button on the motion detector 100 to change operating modes. In another embodiment, the installer can use a remote control device to change the operating modes, i.e., actuate the switch.

The motion detector 100 responds to the actuation of the calibration activating switch calibration activating switch 115 by switching operating modes. After the modes are switched, the motion detector 100 indicates that the motion detector 100 is in a calibration mode, at step 210. The indication instructs or signal the installer to walk to the furthest point in the premises from the motion detector 100/Additionally, the microcontroller 120 sets a timer 124 for a predetermined wait period. The wait period depends on the application of the motion sensor. The wait period is directly proportional to the size of the protected area. The purpose of the wait period is to allow the installer to walk to the furthest distance from the motion detector 100, but still within the protected area. The larger the protected area, the longer the wait period is set.

During the wait period, the installer walks to the furthest distance within the protected area, at step 215.

At step 220, the motion detector 100 indicates that the detector is ready to begin the calibration process. In other words, after the timer 124 expires, the motion detector 100 indicates that it is ready to receive the Doppler signal. As described above, this indication can be a visual or audio indication.

Once the motion detector 100 indicates that the detector is ready, the installer will walk the furthest distance, at step 225. The walking generates a Doppler signal, which is measured and used to calibrate the motion detector. The microwave circuitry 110 receives the Doppler signal and records the signal for measurement. The timer 124 times a second period of time in which the installer walks the furthest distance.

At step 230, at the expiration of the second period of time, the microcontroller 120 sets the detection threshold. The setting of the threshold uses measured amplitude of the recorded Doppler signal as a preset and a preset weighting factor. The microcontroller 120 using the ADC measurement 121 measures the amplitude of the recorded Doppler signal and retrieves the preset weighting factor from the storage section 123. The amplitude can be measured as a peak amplitude or an average amplitude within a predetermined period of time. The microcontroller 120 then uses the measured amplitude to set the detection threshold for later use. The microcontroller

120 multiples the measured amplitude to generate the detection threshold. The detection threshold is used by the microcontroller 120 and, more particularly, the processor 121 when processing the signal from the microwave circuitry 110. The detection threshold is a minimum amplitude threshold for determination of motion. If the detection threshold is not set to a logical level, the motion detector 100 will indicate that the detection threshold is not set. The motion detector 100 can then be re-calibrated. For example, if the detection threshold is substantially out of an expected range, an error signal is generated.

After the detection threshold is stored, the motion detector 100 confirms the end of the calibration process.

Additionally, after the expiration of the second period of time at step 235 the motion detector 100 automatically switches to the alarm mode.

The disclosed method decreases the installation time for the motion detector 100 by allowing the installer to "walk the room" only once. The method also eliminates a need for a potentiometer and its adjustment.

The invention has been described herein with reference to particular exemplary embodiments. Certain alternations and modifications may be apparent to those skilled in the art, without departing from the scope of the invention. The exemplary embodiments are meant to be illustrative, not limiting of the scope of the invention, which is defined by the appended claims.

What is claimed is:

1. A method of automatically calibrating a microwave motion detector comprising the steps of:

setting said microwave motion detector to a calibration mode;

waiting a preset period of time for an installer to walk to a furthest distance in a protected area from said microwave motion detector;

indicating when said preset period of time has expired, said indication is indicative of said microwave motion detector being ready to receive a calibration Doppler signal;

receiving the calibration Doppler signal generated by motion at the furthest distance from said microwave motion detector within the protected area;

measuring an amplitude of said calibration Doppler signal; and storing a motion detection threshold for the microwave motion detector where the motion detection threshold is a proportional to the measured amplitude.

2. The method of automatically calibrating a microwave motion detector according to claim 1, further comprising the step of:

confirming that the motion detection threshold is an adequate setting of the microwave motion detector.

3. A The method of automatically calibrating a microwave motion detector according to claim 1, further comprising the steps of:

timing a second preset period of time in which the installer walks; and resetting said microwave motion detector to alarm mode after the second preset period of time expires.

4. The method of automatically calibrating a microwave motion detector according to claim 1, wherein said motion detection threshold is a threshold setting for generating an alarm.

5. The method of automatically calibrating a microwave motion detector according to claim 1 further comprising the step of:

indicating when said microwave motion detection is reset.

6. The method of automatically calibrating a microwave motion detector according to claim 1, wherein said preset period of time is preset based a microwave motion detector's detection range.

7. The method of automatically calibrating a microwave motion detector according to claim 1, further comprising the step of:

converting said Doppler signal into a digital signal for measurement.

8. A microwave motion detector comprising:

a calibration activation switch for switching to a calibration mode;

a timing section for timing a first preset period of time and a second preset period of time, said first preset period of time being a period depending on a maximum detection distance of the microwave motion detector;

an indicator for indicating when the first preset period of time has expired, said indication being indicative of said microwave motion detector being ready to receive a calibration Doppler signal;

a microwave circuitry for receiving calibration Doppler signals during the second preset period of time in which an installer walks a furthest distance from the microwave motion detector;

a measurement section for measuring an amplitude of said calibration Doppler signals;

a storage section for storing a detection threshold where the detection threshold is a proportional to the measured amplitude; and a notification section for indicating a start of the calibration, and an expiration of the second preset period of time, and if there is trouble with a level of the detection threshold.

9. The microwave motion detector of claim 8, wherein said detection threshold is used by the microwave motion detector for determining whether a received signal is indicative of motion.

10. The microwave motion detector of claim 8, wherein said calibration activation switch is responsive to a remote control device.

11. The microwave motion detector of claim 10, wherein said remote control device is a security system keypad.

12. The microwave motion detector of claim 10, wherein said remote control device is a keyfob.

13. The microwave motion detector of claim 8, further comprising an alarm generation section for generating an alarm based at least upon a comparison between the output of the microwave circuitry and the stored detection threshold.

14. The microwave motion detector of claim 11, further comprising a transceiver for receiving a signal from said security system keypad.

15. The method of automatically calibrating a motion detector according to claim 1, further the step of comprising setting the motion detector threshold, wherein the measured amplitude is multiplied by a preset parameter to generate the motion detection threshold.

16. The microwave motion detector of claim 11, wherein the microwave motion detection is a dual technology motion detector.

* * * * *